United States Patent [19]

Johnson

[11] Patent Number: 4,641,869

[45] Date of Patent: Feb. 10, 1987

[54] DOOR BRACE

[76] Inventor: Lawrence Johnson, P.O. Box 1472, Clovis, N. Mex. 88101

[21] Appl. No.: 866,276

[22] Filed: May 23, 1986

[51] Int. Cl.[4] ..... E05C 17/44

[52] U.S. Cl. ..... 292/339; 292/340

[58] Field of Search ..... 292/338, 339, DIG. 15, 292/340, 346; 254/39

[56] References Cited

U.S. PATENT DOCUMENTS

| | | | |
|---|---|---|---|
| 132,922 | 11/1872 | Pharo | 292/339 |
| 288,920 | 11/1883 | Burrows | 254/39 |
| 1,918,129 | 7/1933 | Phillips | 292/338 |
| 4,186,954 | 2/1980 | Detlefs | 292/340 |
| 4,456,291 | 6/1984 | Brogie | 292/338 |
| 4,547,009 | 10/1985 | Allen | 292/340 X |

*Primary Examiner*—Robert L. Wolfe
*Assistant Examiner*—Russell W. Illich
*Attorney, Agent, or Firm*—Nissle & Leeds

[57] ABSTRACT

An improved door brace. The brace includes an elongate canted arm having an upper end which interlocks with a door and a lower end contacting the floor at a point spaced away from the door. The upper end of the canted brace arm is shaped and dimensioned such that when forced entry is attempted the door is compressed into interlocking engagement with the upper end of the arm. The interlocking engagement of the upper end and the door enables the brace to more effectively resist shear forces which tend to separate the upper end of the brace arm from the door during an attempted forced entry.

1 Claim, 5 Drawing Figures

DOOR BRACE

This invention relates to apparatus for bracing a door against forced entry.

More particularly, the invention relates to an elongate canted door brace having an upper end which interlocks with a door and a lower end contacting the floor at a point spaced away from the door, the upper end being shaped and dimensioned such that when forced entry is attempted the door is compressed into interlocking engagement with the upper end of the brace, the interlocking engagement enabling the brace apparatus to more effectively resist shear forces which tend to separate the upper end of the brace from the door during an attempted forced entry.

Upright canted door braces are well known in the art. The brace includes an elongate canted arm spanning the distance between a door and a point on the floor spaced away from the door. The lower end of the canted arm is adapted to engage and remain in position on the floor. The upper end of the arm is braced against the door handle or against another support member which is bolted or otherwise attached to the door. In general, the weakest component of such prior art door braces is the support member which is affixed to the door and anchors the upper end of the canted arm of the brace. When forced entry is attempted, resultant shear forces can cause the door knob or other support member to be pulled free of the door. Further, repeatedly installing and releasing prior art door braces can, over time, cause the door knob or other support member to work free of the door. Another disadvantage of the many prior art door braces is that they are permanently installed on and detract from the aesthetic appearance of a door.

Accordingly, it would be highly desirable to provide improved door brace apparatus of the type described in which the support member anchoring the upper end of the brace to a door was secured to the door in a fashion which minimized the likelihood that the support member would be separated from the door by shear forces generated during an attempted forced entry through the door.

It would also be highly desirable to provide improved door brace apparatus of the type described which, when the apparatus was not in use, permitted the brace arm to be readily removed and stored at some location away from the door.

Therefore, it is a principal object of the invention to provide improved apparatus for bracing a door against forced entry.

Another object of the invention is to provide improved door brace apparatus of the type including a door mounted support member and a canted elongate arm spanning the distance between the support member and the floor, the support member receiving and anchoring the upper end of the canted arm in position adjacent the door.

A further object of the invention is to provide improved door brace apparatus of the type described in which the support member engages the door in such a manner that the likelihood of the support member being forced apart from the door during an attempted forced entry is minimized.

Still another object of the instant invention is to provide improved door brace apparatus of the type described which permits the canted brace arm to be readily removed and transported to desired storage location and which can be utilized to improve the appearance of a door.

These and other, further and more specific objects and advantages of the invention will be apparent to those skilled in the art from the followed detailed description thereof, taken in conjunction with the drawings, in which.

Figures 1, 2, 3, 4, 5:
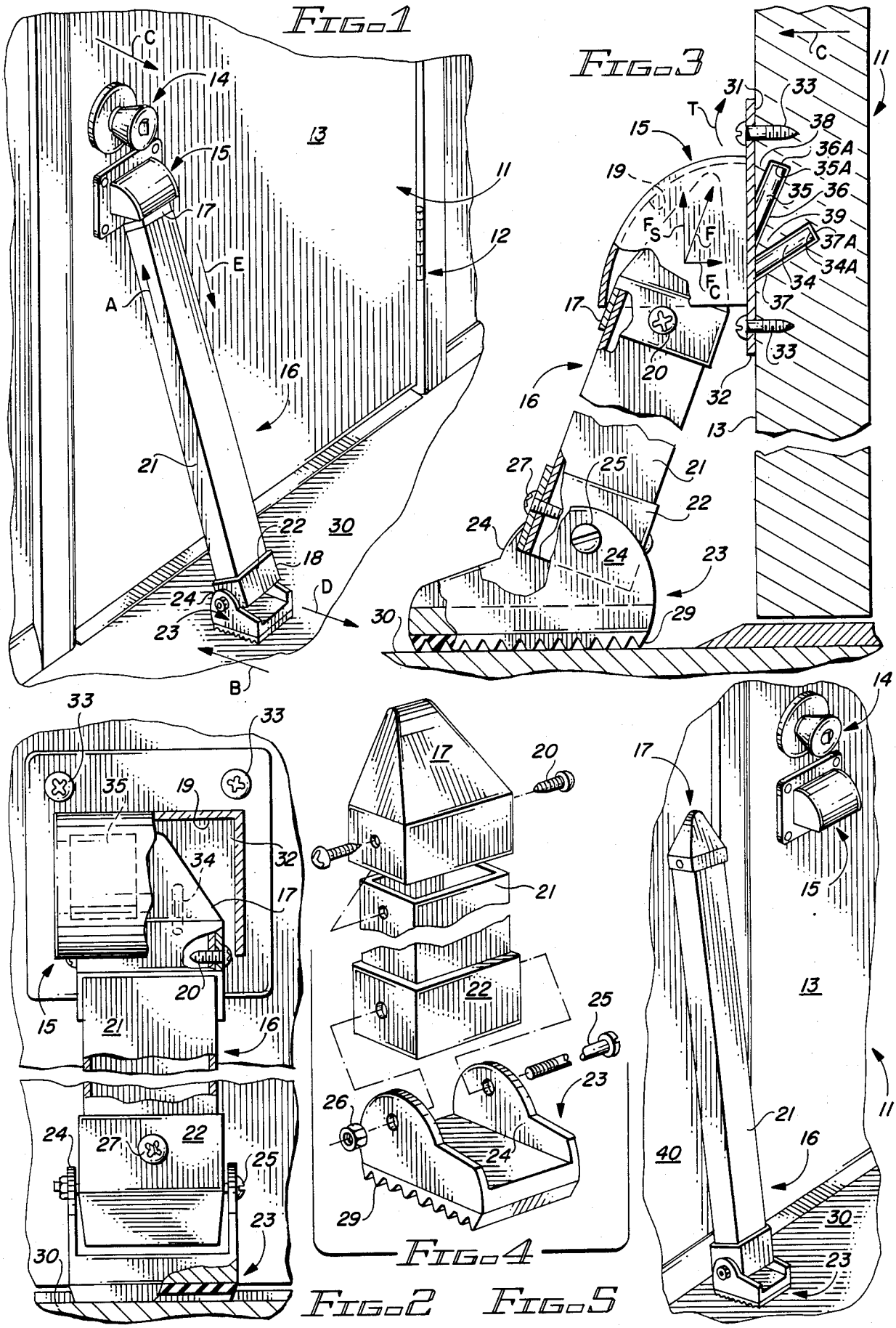
FIG. 1 is a prespective view illustrating door brace apparatus constructed in accordance with the principles of the invention.
FIG. 2 is a front view of the door brace apparatus of FIG. 1 with portions thereof broken away to further illustrate interior construction details thereof.
FIG. 3 is a side view of the door brace apparatus of FIG. 1 with portions thereof broken away to further illustrate interior construction details thereof.
FIG. 4 is a perspective view illustrating the assembly of the apparatus of FIG. 1; and, FIG. 5 is a perspective view of the apparatus of FIG. 1 illustrating the door brace thereof removed to a storage location apart from the door.

Briefly, in accordance with my invention, I provide an improved door assembly. The door assembly includes a frame; a door having a vertically oriented face and an upwardly canted channel formed in the door; a support member including a downwardly opening recess, a back surface contacting the face of the door, and an anchor member attached to the back surface and extending upwardly into the channel; and, an elongate brace member having an upper end positioned in the recess, and a lower end spaced away from the door and adapted to frictionally fixedly engage the floor when a displacement force is applied to the door in a direction generally parallel to the floor and toward the lower end. The door is mountd on the frame for movement between two operative positions. A portion of the door is positioned intermediate the upwardly canted channel and the door face. When the displacement force is applied to the door, the anchor member is forced against the intermediate portion of the door to generally prevent movement of the upper end of the brace member and of the support member away from the door.

Turing now to the drawings, which depict the presently preferred embodiments and best mode of the invention for the purpose of illustrating the practice thereof and not by way of limitation of the scope of the invention and in which like reference characters represent corresponding elements throughout the several views, FIGS. 1–5 illustrate a door assembly constructed in accordance with the principles of the invention and including a door 11 pivotally mounted on frame 12 for movement between at least two operative positions. Door 11 includes vertically oriented planar face 13. Doorknob 14 is mounted in door 11. The door brace utilized in combination with door 13 includes support member 15 and elongate canted brace member 16. Brace member 16 includes conical upper end 17 and lower end 18. Support member 15 includes downwardly opening recess 19 which slidably receives upper end 17 of brace member 16. Threaded screws 20 secure upper end 17 to elongate rectangular rod 21. Lower end 18 includes sleeve 22 pivotally mounted on foot 23. Foot 23 includes upwardly projecting ears 24. Threaded bolt 25 pivotally secures ears 24 to sleeve 22 and to the lower end of arm 21. Screws 27 attach sleeve 22 to arm 21. Elastic rubber tread 29 on foot 23 frictionally fixedly contacts floor 30.

Plate 32 is secured to surface 13 of door 11 by threaded screws 33. Rear surface 31 of plate 32 contacts surface 13 of door 11. Upwardly projecting anchor members 34 and 35 are slidably received by upwardly canted channels 37 and 36, respectively. In FIG. 3, members 35 and 36 are, for purposes of clarity, shown as being of smaller size than upwardly projecting channels 37 and 36. However, anchor members 34 and 35 are preferably only slightly smaller than or equal in size to channels 37 and 36 such that members 34 and 35 are force fit into channels 37 and 36. Adhesive or other affixing means can be utilized to secure members 34 and 35 in channels 37 and 36. A portion 38 of door 11 lies intermediate member 35 and surface 31 of plate 32. Similarly, portion 39 of door 11 lies intermediate member 34 and plate 32.

In use, channels 36 and 37 are formed in door 11, support member 15 is positioned adjacent door 11 and anchor members 34 and 35 are force fit into channels 37 and 36, respectively. Members 34 and 35 can be welded or otherwise permanently affixed to plate 32 or can comprise pins which are driven through apertures formed in plate 32 and into channels 37 and 36. Screws 33 can be utilized to further secure plate 32 to door 11. After door 11 is closed to the position shown in FIG. 1, upper end 17 of brace member 16 is upwardly displaced into recess 19 in the direction of arrow A in FIG. 1 and foot 23 is displaced in the direction of arrow B along floor 30 to force end 17 tightly into recess 19. When support member 15 and brace member 16 are installed as shown in FIG. 1, and an individual attempts to open the door from the other side by applying a displacement force in the direction of arrow C, brace member 16 and support member 16 prevent door 11 from opening.

When a displacement force C is applied to door 11, a force F is generated by upper end 17 against support member 15. Force C is perpendicular to vertical face 13 of door 11, is parallel to floor 30, and is in a direction toward foot 23. Force F includes a shear component $F_S$ and a compression component $F_C$. The shear component $F_S$ of force F acts on screws 33 and tends, with repeated applications of force F to support member 15, to loosen the binding of screws 33 in door 11. Shear component $F_S$ generates a torque, represented by arrow T in FIG. 3, on each screw 33. Upwardly projecting canted anchor members 34 and 35 minimize the proportion of shear component $F_S$ which must be borne by screws 33. Members 34 and 35 distribute a portion of shear component $F_S$ over intermediate portions 39 and 38 of door 11 contacting members 34 and 35. In addition, the torque generated on anchor members 34 and 35 by shear component $F_S$ is substantially less than the torque generated on screws 33. Shear component $F_S$ tends, because of the elasticity of wood and other materials which typically comprise door 11, to upwardly displace support member 15 and compress portion 38 of door 11 between member 35 and plate 32. Portion 39 of door 11 is also compressed between member 34 and plate 32. The utilization of a support member 15 provided with anchor members 34 and 35 which upwardly project into door 11 enables support member 15 to withstand a force F which is substantially greater than the force F which could be withstood by a support member 15 which was only attached to door 11 by screws 33. Anchor members 34 and 35 are preferably fitted in channels 37 and 36 such that ends 34A and 35A of members 34, 35 contact end surfaces 37A and 36A of channels 37 and 36, respectively.

Brace member 16 is removed from the position shown in FIG. 1 by displacing foot 23 away from door 11 along floor 30 in the direction of arrow D and by, as a result, permitting end 17 to downwardly fall from support member 15. After member 16 is disengaged from support member 15, member 16 can be leaned against wall 40 as shown in FIG. 5 or stored at any other convenient location. Being able to remove brace member 16 while leaving support member 15 affixed to door 11 improves the appearance of door 11 when the apparatus of the invention is not being utilized to brace door 11. Support member 15 can be decorated, painted, or shaped and dimensioned to be aesthetically pleasing and to improve the overall appearance of door 11.

Screws 33 need not be utilized to affix support member 15 to door 11. If anchor member 34 is not utilized and member 35 is the only anchor member outwardly projecting from plate 32, member 35 can be force fit into channel 36. After brace member 16 is positioned as shown in FIG. 1 with end 17 projecting into recess 19, member 16 and the frictional fit between member 35 and channel 36 maintain support member 15 is position on door 11.

Having described my invention in such terms as to enable those skilled in the art to understand and practice it, and having identified the presently preferred embodiments and best mode thereof, I Claim:

1. A door assembly, including (a) a frame;

(b) a door having (i) a vertically oriented face, and (ii) an upwardly canted channel formed in said door, said door being mounted on said frame for movement between two operative positions, a portion of said door being positioned intermediate said upwardly canted channel and said face;

(c) a support member including (i) a downwardly opening recess, (ii) a back surface contacting said face of said door, and (iii) an anchor member attached to said back surface and extending upwardly into said channel; and, (d) an elongate brace arm having (i) an upper end positioned in said recess, and (ii) a lower end spaced away from said door and adapted to frictionally fixedly engage said floor when a displacement force is applied to said door in a direction generally parallel to said floor and toward said lower end, said anchor member being forced against said intermediate portion of said door to generally prevent movement of said upper end and support member away from said door when said displacement force is applied to said door.

* * * * *